US007467978B2

(12) United States Patent
Sundermeier

(10) Patent No.: US 7,467,978 B2
(45) Date of Patent: Dec. 23, 2008

(54) CONNECTOR FOR PRE-FABRICATED ELECTRIC CABLES, HAVING SEMI-ENCLOSED CONTACT CHAMBERS

(75) Inventor: Uwe Sundermeier, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/935,249

(22) Filed: Nov. 5, 2007

(65) Prior Publication Data

US 2008/0124983 A1 May 29, 2008

(51) Int. Cl.
*H01R 13/502* (2006.01)

(52) U.S. Cl. ..... 439/690; 439/320

(58) Field of Classification Search ..... 439/690, 439/320, 319, 322, 324, 306, 312, 302, 359, 439/274

See application file for complete search history.

(56) References Cited

U.S. PATENT DOCUMENTS 3,287,031 A * 11/1966 Simmons et al. ..... 285/27
4,915,654 A * 4/1990 Zinn ..... 439/595
6,280,229 B1 * 8/2001 Harting et al. ..... 439/393
6,527,575 B2 * 3/2003 Scholler ..... 439/321
2008/0032556 A1 * 2/2008 Schreier ..... 439/610

FOREIGN PATENT DOCUMENTS

DE 20 2005 017 981 U1 3/2006
DE 20 2006 000 336 U1 4/2006

* cited by examiner

*Primary Examiner*—Hae Moon Hyeon
(74) *Attorney, Agent, or Firm*—Hayes Soloway P.C.

(57) ABSTRACT

In a connector for accommodating individual pre-fabricated electrical cables fitted with electric pin contacts or socket contacts is provided. The connector proposes to insert the electric contacts into longitudinally aligned and semi-enclosed contact chambers and to insert the carrier member into a surrounding connector sleeve, wherein a carrier sleeve arranged within the connector sleeve features raised longitudinal ribs for aligning the electric contacts in the contact chambers. The connector sleeve is composed of a first connector part, a second connector part and a carrier sleeve, wherein the first connector part on the mating side is rotatably arranged on the carrier sleeve while the second connector part that points to the cable connection side is rigidly connected to the carrier sleeve.

6 Claims, 3 Drawing Sheets

CONNECTOR FOR PRE-FABRICATED ELECTRIC CABLES, HAVING SEMI-ENCLOSED CONTACT CHAMBERS

CROSS-REFERENCE TO RELATED APPLICATION

This application claims the benefit of German Patent Application No. 102006055534.1, filed Nov. 24, 2006.

BACKGROUND OF THE INVENTION

1. Field of the Invention

The invention pertains to a connector for connecting pre-fabricated electric cables, in which one end of the individual electric conductors already is rigidly connected to a pin contact or socket contact.

A connector of this type significantly simplifies the installation of pre-fabricated electric cables.

2. Description of the Related Art

The application for an utility model DE 20 2006 000 336 U1 discloses a connector with simplified cable routing, in which electric conductors are also connected to pin contacts or socket contacts and inserted into semienclosed chambers of a cylindrical base body.

Furthermore, DE 20 2005 017 981 U1 describes a contact retention system for an electric connector with a contact carrier for electric contacts on stranded cable conductors, wherein an insulating member sleeve that forms part of an insulating member features through-openings for the electric contacts on its face side.

In known connectors of this type, it is disadvantageous that a fixing sleeve with bores, through which the contacts need to be inserted, is required in all instances.

SUMMARY OF THE INVENTION

Consequently, the invention is based on the objective of developing a connector for connecting pre-fabricated electric cables fitted with pin contacts or socket contacts which can be very easily handled and comprises fewer components.

This objective is attained in that the pin contacts or socket contacts with the individual electric conductors are inserted into semienclosed contact chambers that are aligned along a carrier member, in that the carrier member is inserted into a surrounding connector socket, wherein the connector socket is composed of a first connector part and a second connector part arranged on a carrier sleeve that is open on both sides, and in that the pin contacts or socket contacts aligned in the contact chambers of the carrier member are fixed by means of corresponding longitudinal ribs arranged in the carrier sleeve.

The advantage attained with the invention can be seen, in particular, in the elimination of the otherwise required through-openings in an insulating connector housing of this type, through which the mating side of the pin connectors or socket connectors connected to the stranded conductors need to be inserted.

The inventive connector is realized in the form of a circular connector and features a carrier member with semienclosed contact chambers axially arranged therein, wherein the pin contacts or socket contacts are advantageously inserted into said contact chambers.

Subsequently, the carrier member is inserted into a connector sleeve that consists of a carrier sleeve with a first and a second connector part. The connector sleeve is then screwed down with a conventional pressure screw in order to fix the electric cable.

Since the coating of the individual electric conductors has a slightly larger diameter than the pin contacts or socket contacts, the ends on the mating side are advantageously aligned in the direction of the center when they are fixed in the connector sleeve. Due to this measure, a certain pressure is always exerted upon the contacts in the mating connector during the mating process.

Depending on the respective application, the connector sleeve may consist of an electrically conductive metallic material or a non-conductive material.

DESCRIPTION OF THE PREFERRED EMBODIMENTS

Figure 1:
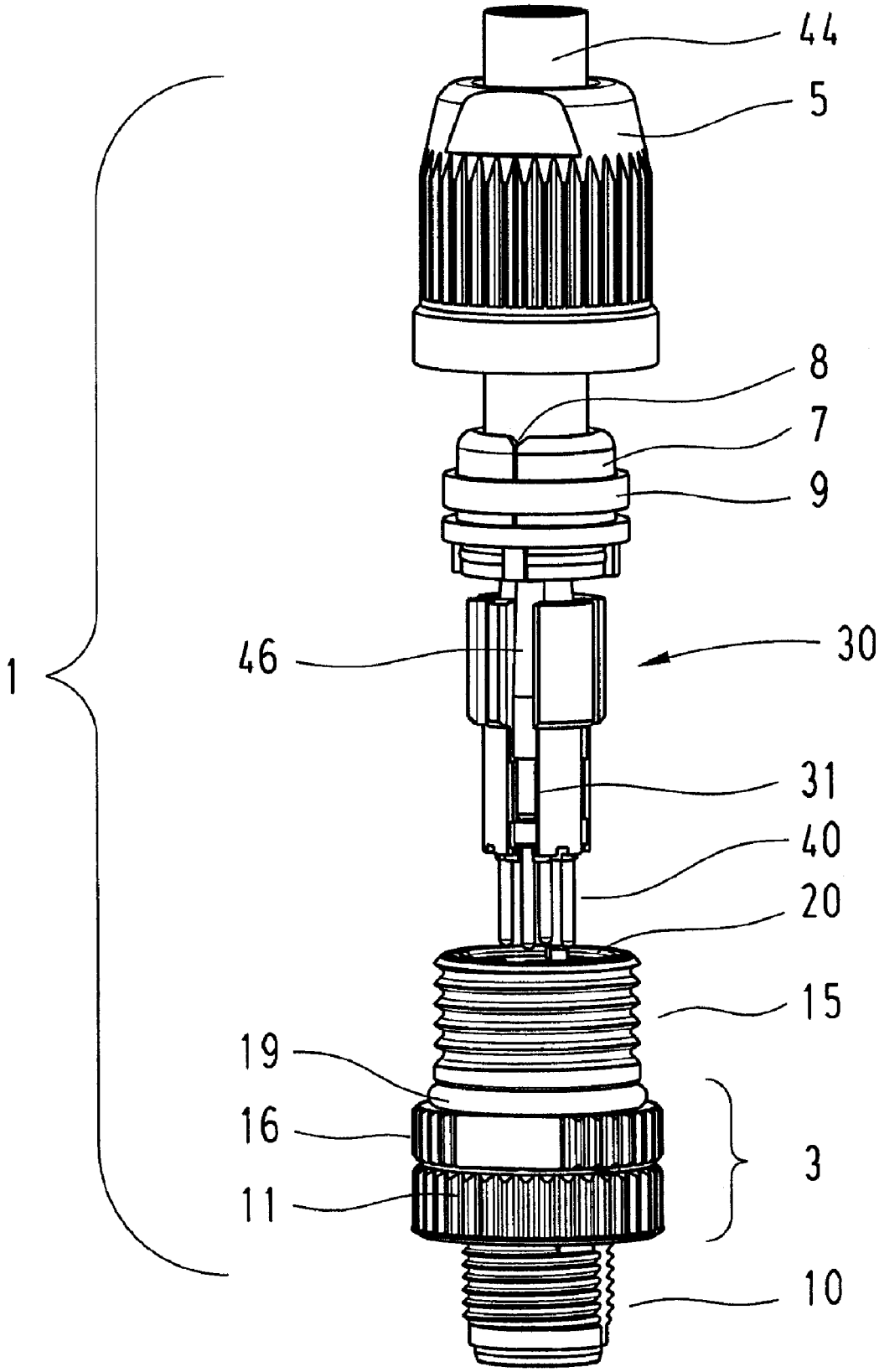
FIG. 1 is a connector with an electric cable in the form of an exploded view.

FIG. 1 shows an exploded isometric representation of a connector 1 that is composed of a connector sleeve 3, a carrier member 30, a sealing insert 7 with a sliding ring 9 and a pressure screw 5.

The connector sleeve consists of connector parts 10, 15 that are attached to an interior carrier sleeve 20.

An electric cable 44 with individual electric conductors 46 is inserted into the sealing insert 7 and fixed by means of the pressure screw 5 that is screwed on the connector sleeve 3.

The sliding ring 9 to be pushed onto the sealing insert 7 is provided for transferring the shielding potential of a shielded cable when a (not-shown) shielding contacts the metallic sliding ring within the slot 8 such that the sliding ring 9 transfers the shielding potential to a mating connector via the electrically conductive pressure screw 5 and the connector sleeve 3.

In addition, a rubber seal 19 is provided on the collar 16 in order to seal the screw connection between the pressure screw and the connector part 15. The pin contacts or socket contacts 40 are respectively crimped on an individual electric conductor 46 and inserted into contact chambers 31 in the carrier member 30.

Figure 2:
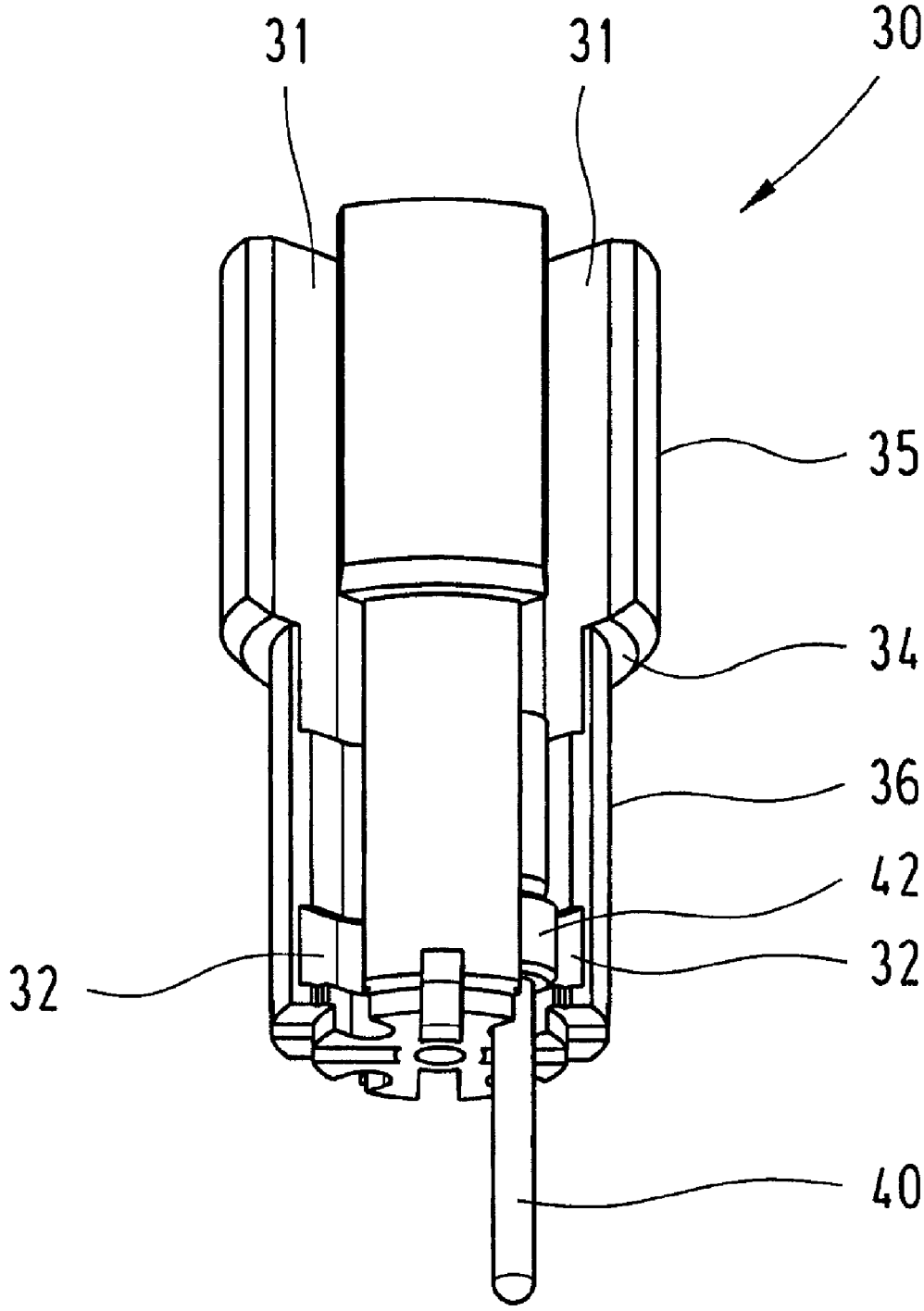
FIG. 2 is a carrier member in the form of an isometric representation.

FIG. 2 shows the carrier member 30 to be accommodated within the connector sleeve 3. The carrier member is realized in the form of a cylindrical member that has two different diameters 35, 36 and is provided with four axially aligned contact chambers 31 that are arranged circularly and uniformly spaced apart from one another. If desired, the contact chambers 31 may feature color markings.

The diameter of the semienclosed elongated contact chambers 31 is respectively adapted to the coating of the individual electric conductors 46 and the pin contacts or socket contacts 40 crimped thereon such that the individual conductors are at least provisionally held in the contact chambers 31 during the installation until the carrier member 30 is inserted into the connector sleeve 20.

In order to realize a precisely fitted arrangement of the pin contacts or socket contacts, each contact chamber features a positioning recess 32, into which corresponding positioning projections 42 on the pin contacts or socket contacts 40 can be inserted.

Figure 3:
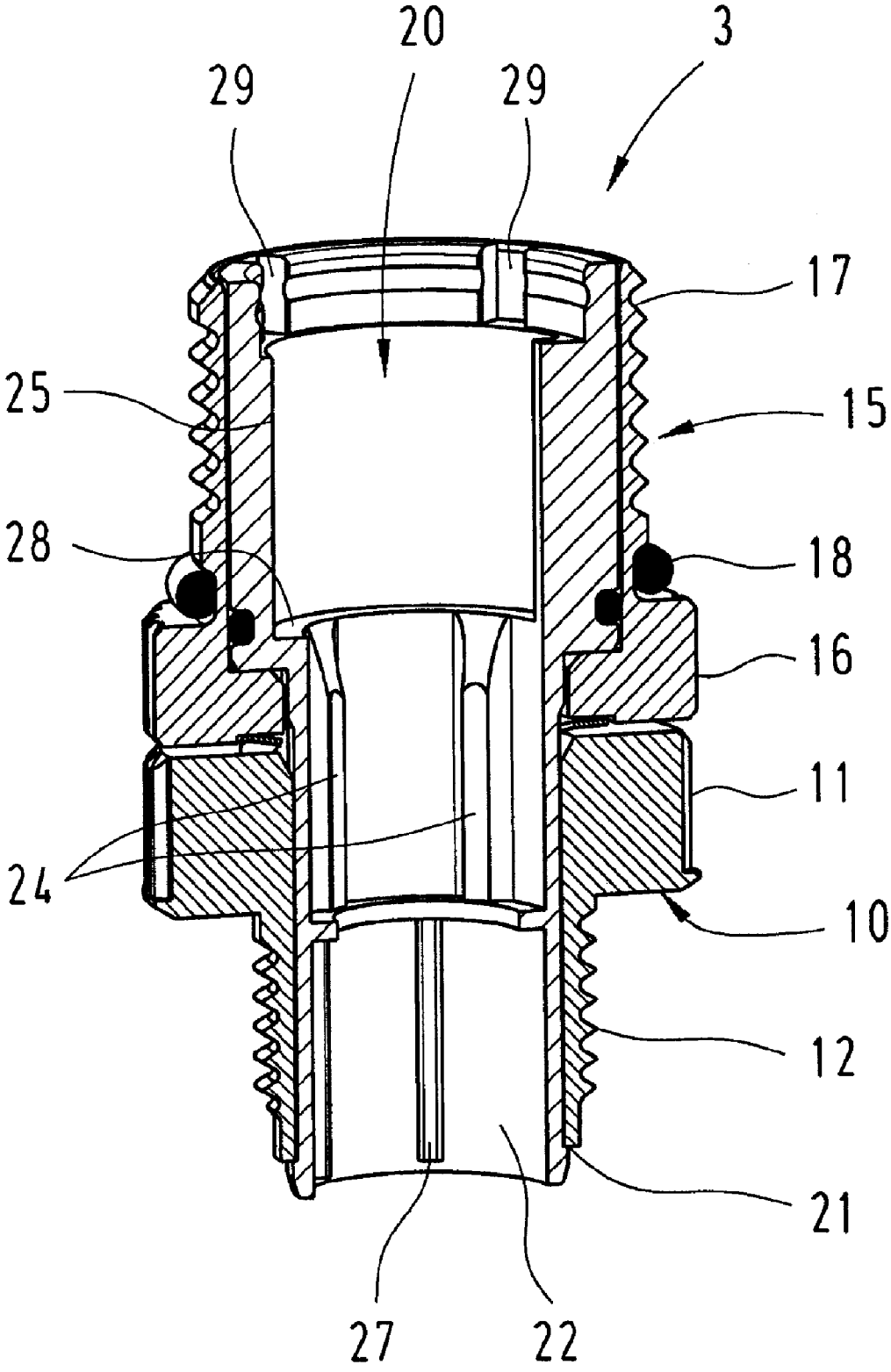
FIG. 3 is a connector sleeve in the form of a sectional representation.

FIG. 3 shows a sectional presentation of the metallic connector sleeve 3 with the two connector parts 10, 15 that are arranged on a non-conductive carrier sleeve 20 such that they can be turned relative to one another. In this case, the connector part 15 on the connection side is rigidly connected to the carrier sleeve 20 while the connector part 10 on the mating side can be turned on the carrier sleeve 20, but is held thereon in a captive fashion by the means of a collar 21.

Both connector parts feature an external thread 12, 17, as well as a collar 11, 21 with a knurling.

The external thread 12 that points to the mating side is provided for producing a connection with a mating connector 1 while the external thread 17 is provided for being fixed by means of the pressure screw 5.

When the pressure screw 5 is screwed in, the elastic sealing insert 7 is pressed against the inner wall of the pressure screw, wherein the electric cable 44 extending in the sealing insert is non-positively acted upon and protects the connector from environmental influences.

In addition, the elastic sealing insert 7 is provided with four short extensions that are respectively engaged with guide grooves in the form of recesses 29 in the carrier sleeve 20 in order to fix the sealing insert 7 such that it cannot be turned relative to the connector sleeve when the pressure screw 5 is screwed on the connector sleeve.

Two of the four longitudinal ribs 24 are visible on the inner wall of the carrier sleeve 20, wherein these longitudinal ribs fix the pin contacts or socket contacts 40 in the contact chambers 31 in a precisely fitted fashion during the connector installation once the carrier member 30 is inserted into the carrier sleeve 20. The carrier member is inserted into the carrier sleeve until the two stopping edges 28 of the carrier sleeve and the stopping edge 34 of the carrier member contact one another.

In this case, the longitudinal ribs 24 are angled beginning at a stopping edge 28 in the upper third of the carrier sleeve 20 in order to initially position the electric contacts.

Another longitudinal rib 27 is provided in the mating region of the carrier sleeve 20 for the polarization with a corresponding mating connector.

In addition, the ends of the electric contacts 40 on the mating side are aligned toward the center in a slightly angled fashion within the parallel contact chambers 31 due to the fact that the coating of the electric conductors has a larger diameter than the electric contacts 40, wherein this aspect of has very positive effects on the contacting properties of pin contacts and socket contacts.

What is claimed is:

1. A connector for connecting pre-fabricated electric cables, of the type comprising a plurality of individual electric conductors, in which one end of each of the individual electric conductors is rigidly connected to a pin contact or socket contact, wherein the pin contacts or socket contacts with the individual electric conductors are inserted into semi-enclosed contact chambers that are aligned along a carrier member, the carrier member is inserted into a surrounding connector sleeve, wherein the connector sleeve is composed of a first connector part that points to the mating side of the connector and a second connector part that points to the cable connector side of the connector arranged on a carrier sleeve that is open on both sides, and the pin contacts or socket contacts aligned in the contact chambers of the carrier member are fixed by corresponding longitudinal ribs arranged in the carrier sleeve.

2. The connector according to claim 1, wherein the first connector part of the connector sleeve is held on the carrier sleeve in a freely rotatable fashion by a collar, and the second connector part or the connector sleeve is connected to the carrier sleeve.

3. The connector according to claim 1, wherein the carrier sleeve features raised longitudinal ribs that are directed inward and axially aligned for fixing the pin contacts or socket contacts in the contact chambers when the carrier member is inserted into the carrier sleeve.

4. The connector according to claim 1, wherein the carrier member features a guide groove that is engaged with an axially aligned rib on the carrier sleeve for positioning purposes.

5. The connector according to claim 1, wherein the contact chambers are circularly arranged around the carrier member and feature color markings.

6. The connector according to claim 1, wherein the electric contacts are positioned in a positioning recess in the contact chamber by integral positioning projections of the electric contacts.

* * * * *